US012234658B2

(12) United States Patent
Vakaliuk et al.

(10) Patent No.: US 12,234,658 B2
(45) Date of Patent: Feb. 25, 2025

(54) METHOD FOR PRODUCING A TEXTILE TRANSVERSE FORCE REINFORCEMENT, SUPPORTING DEVICE, TRANSVERSE FORCE REINFORCEMENT, CONCRETE COMPONENT, AND YARN PLACEMENT FILE

(71) Applicant: Maria Patricia Garibaldi, Hohenstein-Ernstthal (DE)

(72) Inventors: Iurii Vakaliuk, Dresden (DE); Maria Patricia Garibaldi, Hohenstein-Ernstthal (DE); Steffen Rittner, Dresden (DE)

(73) Assignee: Maria Garibaldi, Hohenstein-Ernstthal (DE)

( * ) Notice: Subject to any disclaimer, the term of this patent is extended or adjusted under 35 U.S.C. 154(b) by 0 days.

(21) Appl. No.: 17/766,224

(22) PCT Filed: Oct. 2, 2020

(86) PCT No.: PCT/DE2020/100848
§ 371 (c)(1),
(2) Date: Apr. 2, 2022

(87) PCT Pub. No.: WO2021/063451
PCT Pub. Date: Apr. 8, 2021

(65) Prior Publication Data

US 2024/0052652 A1 Feb. 15, 2024

(30) Foreign Application Priority Data

Oct. 2, 2019 (DE) ..... 102019126608

(51) Int. Cl.
*E04G 21/12* (2006.01)
*E04C 5/06* (2006.01)
*E04C 5/07* (2006.01)

(52) U.S. Cl.
CPC ..... *E04G 21/12* (2013.01); *E04C 5/0645* (2013.01); *E04C 5/07* (2013.01)

(58) Field of Classification Search
CPC ..... E04G 21/12; E04C 5/07; E04C 5/0645
See application file for complete search history.

(56) References Cited

U.S. PATENT DOCUMENTS 4,183,232 A * 1/1980 Banos ..... D03D 41/004 139/22
4,658,577 A * 4/1987 Klein ..... H02G 11/006 59/78.1

(Continued)

FOREIGN PATENT DOCUMENTS

DE 202005019077 U1 4/2007
DE 102007038932 A1 2/2009

(Continued)

*Primary Examiner* — Seahee Hong
(74) *Attorney, Agent, or Firm* — Michael Soderman

(57) ABSTRACT

The invention relates to a method and a supporting device (1) for producing a textile transverse force reinforcement, formed from at least one yarn (17) comprising fibers suitable for load transfer. According to the invention, it is provided that the transverse force reinforcement (5) or the supporting device (1) can be produced or curved in at least one plane perpendicular to the cross section of the transverse force reinforcement (5), wherein placement of the yarn (17) for forming the transverse force reinforcement (5) takes place on the supporting device (1). The supporting device (1) comprises hinged support elements (2) connected to each other in a degree of freedom. The invention further relates to a transverse force reinforcement and its use to reinforce and simultaneously connect two shells of a concrete sandwich structure. The invention also relates to a concrete structural component and a yarn placement file.

7 Claims, 7 Drawing Sheets

(56) References Cited

U.S. PATENT DOCUMENTS

| | | | | | |
|---|---|---|---|---|---|
| 4,805,422 | A * | 2/1989 | Cahuzac | D03D 41/004 | 66/13 |
| 5,016,841 | A * | 5/1991 | Schumann | H02G 11/006 | 248/51 |
| 5,366,063 | A * | 11/1994 | Pollock | B65G 47/5154 | 198/347.3 |
| 5,642,612 | A * | 7/1997 | Hughes | F16G 13/16 | 59/78.1 |
| 7,240,477 | B1 * | 7/2007 | Dunfee | F16L 3/26 | 248/51 |
| 9,941,677 | B2 * | 4/2018 | Hagi | B60R 16/0215 | |

FOREIGN PATENT DOCUMENTS

| | | | |
|---|---|---|---|
| DE | 102014200792 | A1 | 7/2015 |
| DE | 102016100455 | A1 | 7/2016 |
| DE | 102016124226 | A1 | 6/2017 |
| EP | 3017123 | A1 | 5/2016 |
| WO | 2013102593 | A1 | 7/2013 |
| WO | 2018185600 | A1 | 10/2018 |

* cited by examiner

METHOD FOR PRODUCING A TEXTILE TRANSVERSE FORCE REINFORCEMENT, SUPPORTING DEVICE, TRANSVERSE FORCE REINFORCEMENT, CONCRETE COMPONENT, AND YARN PLACEMENT FILE

CROSS REFERENCE TO RELATED APPLICATIONS

This application is the U.S. national stage of International Application No. PCT/DE2020/100848, filed on 2020 Oct. 2. The international application claims the priority of DE 102019126608.4 filed on 2019 Oct. 2; all applications are incorporated by reference herein in their entirety.

BACKGROUND

The invention relates to a method for producing a textile transverse force reinforcement formed from at least one yarn comprising fibers suitable for load transfer and to a supporting device for producing a textile transverse force reinforcement formed from at least one yarn comprising fibers suitable for load transfer. The invention also relates to a transverse force reinforcement formed from at least one yarn, a use of transverse force reinforcement, a concrete component comprising double-shell concrete structural modules, and a yarn placement file.

From the genre-forming publication DE 10 2016 124 226 A1, a grid girder and a method for its production are known, wherein arrays of thread- or yarn-shaped individual elements are provided. These are arranged as sections of a chord and struts and in such a way that their multiplicity results in an overall load-bearing capacity of the grid girder. Straight-line stretched grid girders can be produced, but they are unsuitable for differently shaped components.

Also, according to publication EP 3 017 123 A1, reinforcement structures are provided, which are designed as three-dimensional textile grid structures, and from the publication DE 10 2014 200 792 A1, another building textile is known. Likewise, a box-grid structure is known from the publication WO 2013 102 593 A1.

The publication DE 10 2007 038 932 A1 describes a textile-matrix composite to produce components with an elliptical or circular cross-section, which consists of a grid-like, pre-curved narrow textile embedded in a matrix. Although the textile-matrix composite can be curved in any longitudinal direction, it is produced from the prefabricated grid-like narrow textile so that no substantial load transfer in the longitudinal direction is possible.

The publication DE 20 2005 019 077 U1 moreover describes the production of a textile transverse force reinforcement (cf. FIG. 2 and claims 1, 4, 10, 13, 19) made of fibers suitable for load transfer, wherein the transverse force reinforcement is produced curved in at least one plane perpendicular to its cross section. However, it is not described in which way such a production can be carried out.

The publication WO 2018/185 600 A1 discloses a method for producing a textile reinforcement (cf. FIGS. 1 and 3, claims 1 and 2), formed from at least one yarn 8 comprising fibers suitable for load transfer, wherein the reinforcement can be produced curved in at least one plane perpendicular to its cross section (cf. FIGS. 1 and 3) by depositing the yarn 8 for forming the reinforcement on individual fixing pins 5 arranged transversely to a longitudinal line running curved in the plane.

All textile reinforcement structures known in the prior art, or reinforcement structures based on yarns, rovings, or other textile fibers, have in common that they can only be produced in a rectilinearly stretched or flat, two-dimensional form. This applies particularly to such reinforcement structures, which are subsequently formed from a planar textile grid into a two-dimensional cross-section. This entails disadvantages in terms of load-bearing, combined with increased costs during the production.

SUMMARY

The invention relates to a method and a supporting device (1) for producing a textile transverse force reinforcement, formed from at least one yarn (17) comprising fibers suitable for load transfer. According to the invention, it is provided that the transverse force reinforcement (5) or the supporting device (1) can be produced or curved in at least one plane perpendicular to the cross section of the transverse force reinforcement (5), wherein placement of the yarn (17) for forming the transverse force reinforcement (5) takes place on the supporting device (1). The supporting device (1) comprises hinged support elements (2) connected to each other in a degree of freedom. The invention further relates to a transverse force reinforcement and its use to reinforce and simultaneously connect two shells of a concrete sandwich structure. The invention also relates to a concrete structural component and a yarn placement file.

DETAILED DESCRIPTION

Therefore, it is an object of the present invention to provide a method and a supporting device for producing a textile transverse force reinforcement formed of at least one yarn, wherein a curvature of the transverse force reinforcement in at least one plane shall be possible. It is further an object of the present invention to propose a transverse force reinforcement, its use, a concrete component, and a yarn placement file.

The problem is solved by a method for producing a textile transverse force reinforcement, formed from at least one yarn. According to the invention, it is foreseen that the transverse force reinforcement can be produced curved in at least one plane perpendicular to its cross section by depositing the yarn for forming the transverse force reinforcement on a supporting device bendable in the plane. The supporting device consists of support elements hinged to each other in a degree of freedom. After the hardening of the curable matrix material, the finished transverse force reinforcement is removed from the supporting device. A longitudinal direction of the transverse force reinforcement is considered to be perpendicular to the cross-section. The yarn is deposited on the hinged support elements. According to a preferred embodiment of the process, the yarn is impregnated with the curable matrix material.

The process sequence, according to the invention, is designed in such a way that the supporting device is placed in a linearly stretched form on a supporting surface.

This supporting surface, which can be designed as a table, for example, is designed as a flat surface with a suitable surface property that enables controlled movement of the supporting device. To achieve these surface properties, the support surface may be provided with an additional layer, for example, to reduce friction between the surface and the components. For example, the support surface can be made of metal or a steel sheet, which is typical for the conventional production of concrete components on a formwork.

The second step of the production process, as provided by the invention, is the adjustment of the supporting device to bring it into a shape corresponding to the horizontal projection of the intended curvature of the reinforcement element to be produced, the transverse force reinforcement in the sense of the invention. With the adjustment, the intended curvature of the supporting device for the horizontal projection of the curvature of the reinforcement element to be produced is adjusted by deflecting individual or, in particular, several of the support elements from their initial rectilinear or other existing orientation. This can be done, for example, by forming actuators that act mechanically on the support elements, in particular by motor, displace the support elements in this way and thus achieve the required deflection. The design and function of the form actuators will be discussed in more detail in the description of the device according to the invention.

The next step within the production process of the transverse force reinforcement, according to the invention, is the placement of the yarn, which forms the transverse force reinforcement and carries forces when used in a component, onto the supporting device. This is done following an intended course of the yarn, which ensures, for example, that the load is transferred in the subsequent concrete component in a manner appropriate to the load. Accordingly, immediately after the yarn is deposited, it is in an uncured stage, held by the supporting device, to then cure to form the transverse force reinforcement according to the invention.

Different methods and materials are provided for fixing the yarns after placement. According to the first method, the yarn used is a hybrid fiber to which thermoplastic and thus thermally activable fibers have been added during production. During thermal activation after yarn placement, the thermoplastic fibers melt and bond together the fibers suitable for load transfer, e.g., carbon fibers. In this case, the matrix material is cured as soon as the thermoplastic fibers have cooled down and returned to their solid aggregate state.

According to a second method, the yarn is impregnated with a curable matrix material. This may be done during the yarn production, wherein the yarn is used pre-impregnated and must be protected from undesirable premature curing prior to use. According to a third method, yarn is also impregnated with a curable matrix material, but immediately before being deposited on the supporting device. Preferably, reactive resins, such as epoxy resin, or aqueous dispersions, e.g., based on acrylate or styrene butadiene, are considered as curable matrix material for impregnation.

As soon as the matrix material has cured, the last step is carried out, and the cured transverse force reinforcement is removed from the supporting device. This concludes the process, according to the invention, and completes the transverse force reinforcement.

The invention further relates to a supporting device for producing a textile transverse force reinforcement formed from at least one yarn comprising fibers suitable for load transfer. The supporting device is bendable in the longitudinal direction in at least one plane perpendicular to its cross-section, wherein the supporting device is provided for supporting the yarn and comprises support elements connected to each other utilizing hinges, achieving a degree of freedom. A supporting surface for supporting the supporting device is further provided.

According to a preferred embodiment, the supporting surface for the supporting device is provided with a friction-reducing coating. Preferably, a yarn placement device for automated yarn placement is also provided, which particularly preferably also impregnates the yarn with a suitable matrix material immediately before placement. According to the invention, the transverse reinforcement can thus be produced curved in the longitudinal direction in at least one plane perpendicular to the cross-section.

Before it is used, the supporting device can be assembled from the associated parts, in particular the support elements, in the intended dimensions, the required length for the transverse force reinforcement to be produced. For further transverse force reinforcements to be produced in the same dimensions, the supporting device can be left assembled, cleaned, or repaired if necessary.

It has proved advantageous if the yarn is deposited automatically utilizing a yarn depositing device and thus with exceptionally high precision, efficiency, and variety of shapes. The yarns used are simple yarns or multiple yarns, which are suitable for reinforcement due to an appropriate proportion of load-bearing fibers. These can be, for example, yarns based on carbon fibers, basalt fibers, or alkali-resistant glass fibers (AR glass).

A further advantageous embodiment of the present invention provides for the support elements to be deflected relative to one another using motor-driven shaping actuators, which can produce a force effect on the support elements, in such a way that the intended curvature of the supporting device is achieved. An advantageous further development provides for shaping actuators acting from both sides of the support elements in the plane, possibly including associated compensating strips. Thereby a higher precision of the alignment is achieved.

The transverse force reinforcement can thereby be curved in the longitudinal direction in at least one plane perpendicular to the cross section. This means a deflection at a certain angle with respect to the tangent. The curvature can take place along the length of the transverse force reinforcement in alternating directions, but according to a preferred embodiment, always in the horizontal plane of the transverse force reinforcement. Alternative embodiments also provide for curvature in other planes, up to and including the creation of a freeform. The freeform includes a single curvature, a double curvature, a ruled surface composed of straight lines in a specific way, a surface of revolution, a translational surface, a non-uniform rational B-spline (NURBS, a mathematically defined curve or surface for arbitrary modeling shapes), and geometrically undefined surfaces.

The plane of curvature perpendicular to the cross section of the transverse force reinforcement is usually a horizontal plane formed by a support surface or table. The supporting device is placed on the support surface, and the corresponding curvature is set in preparation for the upcoming yarn placement.

Advantageously, the hinges of the support elements, around which the curvature takes place, are formed by cooperation with a center chain, in that each of the support elements has a central cylindrical recess in which a corresponding cylindrical hinge head of the center chain can be received. The connection between the hinge head and the support element is preferably designed to be movable in order to avoid collisions of the support elements. For its part, the center chain consists of links connected in a hinged manner with a degree of freedom.

The construction of the center chain from links and the support elements that can be placed on them enable the supporting device to be flexibly assembled to suit the requirements of the individual case. Thus, by omitting to fix pins or entire support elements, larger spacing can be created for the yarn placement.

According to an advantageous embodiment, the support element comprises at least one magnet so that the support element is held on the hinge head using magnetic force and, at the same time, two links of the center chain are held together at their hinges by means of this magnetic force. Thus, three different elements are held together. Such a type of connection not only enables a secure connection between the elements involved but also ensures the required mobility, for example, by selecting a correspondingly high magnetic force taking into account the friction between the elements of the center chain or between the support surface and the center chain.

In this context, there is a further advantage if the support surface is made of steel. In this case, the magnets also hold the entire supporting device on the support surface in the shape intended for the yarn deposit, particularly the curvature desired according to the invention.

Advantageously, the links of the center chain can be detached from each other and reassembled. This makes it possible to create a supporting device of any length. It is provided that each support element is supported by a link of the center chain, in particular at a node point of the center chain. This fixation at the node point allows rotation at a certain angle around the axis of the node point of the respective link.

Each support element comprises a base body and at least one fixing pin, preferably two fixing pins arranged opposite to each other. Furthermore, the base body has a clearance on its side facing the center chain, in which the center chain engages and which allows rotation at a certain angle about the axis of the node point of the respective link of the chain. The clearance also makes it possible for both the center chain and each support element to rest flat on the support surface and provide the best possible support for the supporting device.

According to one embodiment of the center chain, at least two adjacent support elements are mechanically coupled for coordinated movement. This coupling can be achieved, for example, by each support element having a gear segment and thereby the support elements being in engagement with each other by means of the gear segments. Such coordinating mechanical coupling prevents the support element's unpredictable and unstable movement behavior relative to the center chain.

It has proved advantageous if the supporting device comprises fixing pins around which the yarn is laid and thereby deflected during deposit. The fixing pins can preferably be arranged at the two ends of the support element facing away from the central cylindrical recess.

Furthermore, it is favorable if the fixing pins have grooves and/or a soft pin coating to secure the position of the yarn. The design of the fixing pins is of particular importance because they ultimately determine the position of the yarn in the transverse force reinforcement to be produced. Once deposited, the yarn is immediately connected to the fixing pins and remains there at least until the matrix material has cured. For this reason, the fixing pins require a design that, on the one hand, allows enough flexibility in production and, on the other hand, allows the yarn to be securely fixed during the first stage of the process, in which the yarn is placed on the supporting device. For this purpose, each fixing pin has a pin base body, a head, and corresponding grooves. In particular, the area of the fixing pins that comes into contact with the yarn is important. In the direction in which the yarn, cured after placement, is then withdrawn from the supporting device as finished transverse force reinforcement, the grooves can be chamfered to facilitate demolding, the removal of the finished cured transverse force reinforcement from the supporting device.

Advantageously, the fixing pins are designed to be exchangeable to adapt them to corresponding requirements, for example to adapt the arrangement of the groove or several grooves in the fixing pin to the intended position of the yarn in the subsequent placement. The height of the transverse force reinforcement to be produced can also be influenced by selecting fixing pins of a different or a specific length. For simplified and, in particular, automated replacement or insertion of the fixing pins, these have, according to a preferred embodiment, a specially shaped pin head which enables them to be grasped mechanically from a magazine and inserted in the support element or vice versa. The locating pins are preferably made of steel.

Instead of grooves, the pin base body, even without grooves, can, for example, be of continuous cylindrical design and have a unique surface, in particular a soft pin coating, all around, but at least on the side against which the yarn rests on the inserted pin. This soft pin coating allows local deformation after the yarn has been laid down under tension. This deformation forms a temporary local indentation, thereby securing the position of the yarn after it has been placed. This allows flexible placement, especially concerning the height position of the yarn, without having to use specific fixing pins with a fixed arrangement of grooves. The yarn placement at different heights on the fixing pins enables a further dimension with the height perpendicular to the plane in the formation of the transverse force reinforcement.

Another alternative in the design of the fixing pins is the use of telescopic fixing pins so that their lengths can be varied without inserting new fixing pins each time. As a result, standardized fixing pins can be used, and there is no need to change them depending on the shear reinforcement to be produced.

To ensure interchangeability, the fixing pins are threaded at one end, for example, to be screwed into the support element. Other types of fastener are provided, such as a twist-lock fastener.

According to a preferred embodiment, shaping actuators and compensating strips are provided, wherein the shaping actuators, e.g., hydraulically, pneumatically, or electrically driven, are designed to exert a lateral force on the support elements, preferably on both sides, with the direction of action in the plane of the curvature. The action takes place until the intended curvature of the supporting device is achieved by the corresponding deflection of the support elements. The compensating strips distribute the force effect of the forming actuators evenly over the support elements. As a result, a uniform deformation of the supporting device, the desired curvature, is formed. The compensating strips are preferably made of a suitably flexible, elastic material such as rubber, silicone, or the like.

Another aspect of the present invention relates to a transverse force reinforcement formed from at least one yarn according to a method according to any one of claims 1 to 5. The transverse force reinforcement has, for example, a C-, double-T-, Z-, I- or L-shaped cross-section. The profile may change along the length of the transverse force reinforcement, for example, from a C to a double-T profile. Transverse force reinforcement can also be used as flexural, tensile, or compressive reinforcement in columns, beams, slabs, and transverse frames. The transverse force reinforcement is formed by the yarn arranged in the form of a shear grid, wherein the shear grid-shaped arrangement of the yarn form the walls of the transverse force reinforcement.

The use of transverse force reinforcement, according to claim 14, also contributes to the solution of the task according to the invention. The transverse force reinforcement is used to reinforce two shells of a concrete sandwich structure and, at the same time to connect them to each other at a distance from each other.

The present invention makes it possible to produce concrete elements which require a correspondingly shaped reinforcement. The task of the invention is therefore also solved by a concrete component comprising two-shell concrete structural modules, the shells of which are reinforced and connected utilizing a transverse force reinforcement according to claim 14, wherein the concrete structural modules have yarn loops and are connected to the concrete element using the yarn loops by edge connectors. It thus becomes possible to mass-produce various shapes in flat or complex-shaped structures. The concrete elements can be single or modular elements, having, for example, a convex or concave shape. The direct shaping of the reinforcement fibers based on the present invention helps avoid waste in the cutting of reinforcement material and thus contributes to material savings since all the fibers used are used as reinforcement. In addition, it is possible to produce the transverse force reinforcement in an optimized and load-related manner. The concrete elements, according to the invention, comprise both precast elements, in particular prefabricated concrete structural modules and concrete components designed as in-situ concrete.

Through the present invention, high tensile and compressive stability of the transverse force reinforcement or the subsequent concrete component can be achieved. A complex layout can be executed within a very small space provided for the transverse force reinforcement. Any unique concrete component, particularly a sandwich element, can be produced as required and in virtually any shape and dimension.

As can be produced by the present invention, the textile transverse force reinforcement is particularly suitable for use in the sandwich element. In this case, the two concrete modules, the inner and outer shells, can be joined together. According to the invention, the process allows high flexibility of production and, despite high productivity, a good possibility of customization. In particular, however, yarn placement can be carried out with the highest precision and efficiency while at the same time enabling the production of complex shapes. During the production of the transverse reinforcement, high stability against tension and compression can be ensured. A complex layout can be executed within small available spaces.

The invention also relates to a thread placement file according to claim 17, wherein the yarn placement file comprises a procedure or algorithm for controlling an automated or computer-controlled yarn placement device according to claim 5.

BRIEF DESCRIPTION OF THE DRAWINGS

Based on the description of embodiments and their illustration in the accompanying drawings, the invention is explained in more detail below. Showing.

DETAILED DESCRIPTION OF THE PREFERRED EMBODIMENTS

Figure 1:
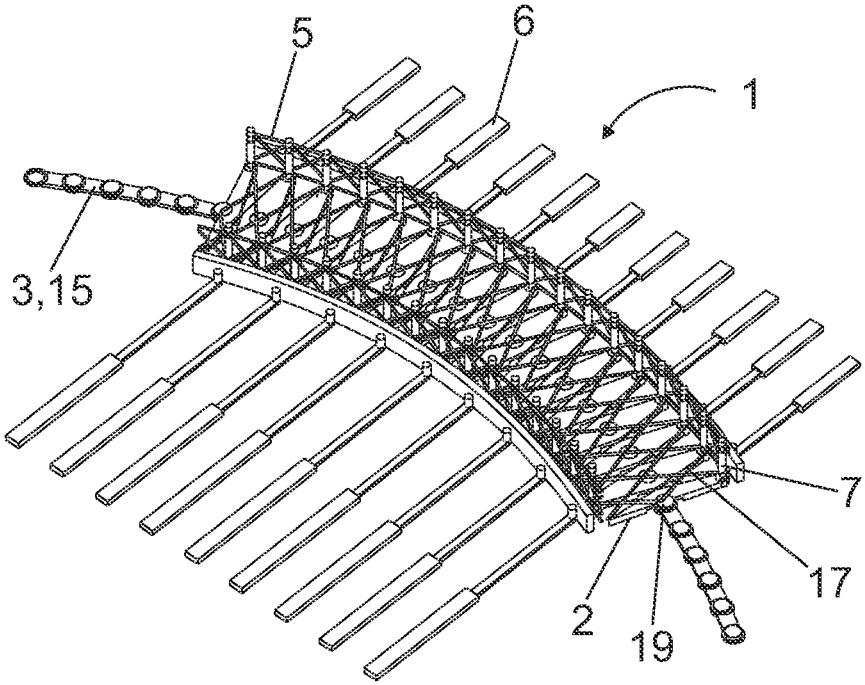
FIG. 1: Schematic perspective view of an embodiment of a supporting device according to the invention with the transverse force reinforcement according to the invention.

FIG. 1 schematically shows a perspective view of an embodiment of a supporting device 1 according to the invention with a textile transverse force reinforcement 5 according to the invention, wherein the supporting device 1 is curved in the plane. The curvature is made possible by a center chain 3 comprising individual links 15.

Each link 15 of the center chain 3 can be connected to a support element 2 in the region of node point 19. The support element 2 can be provided with fixing pins 7 over which a yarn 17 can be laid. Appropriate placement of the yarn 17 around the fixing pins 7 results in the transverse force reinforcement 5, which can be produced by the supporting device 1 according to the invention. Using shaping actuators 6, the desired curvature can be achieved without manual intervention.

Figure 2:
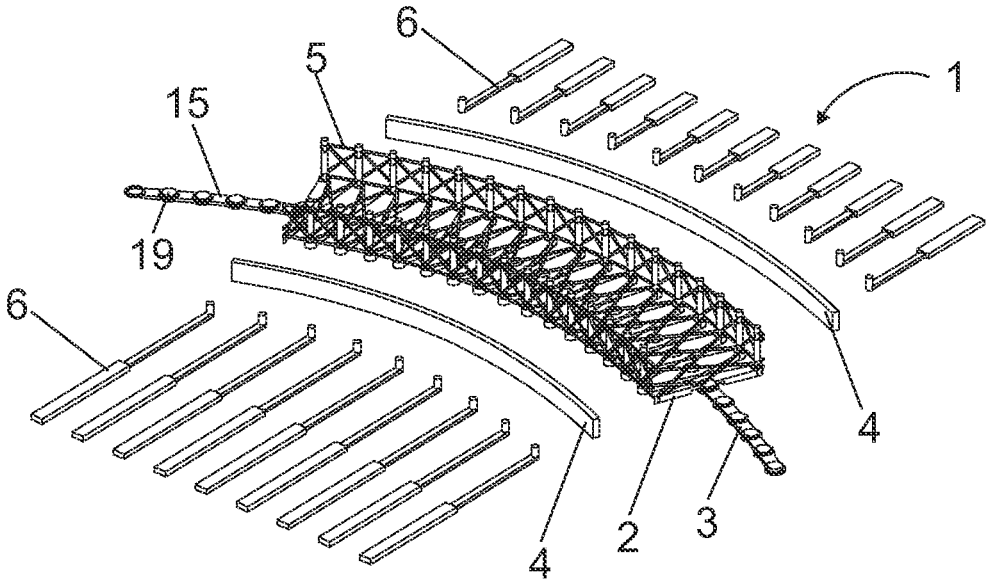
FIG. 2: Schematic exploded perspective view of an embodiment of a supporting device according to the invention with the transverse force reinforcement according to the invention.

FIG. 2 schematically shows an exploded perspective view of an embodiment of a supporting device 1 according to the invention with the transverse force reinforcement 5 to be produced. The curvature of the supporting device 1 with the support elements 2 is made possible by the center chain 3, which comprises the individual links 15 with the two-node points 19 in each case, and is caused by the action of the shaping actuators 6. In addition to the form actuators 6, compensating strips, 4 are also involved in causing the curvature. The compensating strips 4 transmit the force effect of the shaping actuator 6 and enable a uniform curvature over the entire length of the supporting device 1, although the shaping actuators 6 in themselves only act locally on the supporting device 1.

Figure 3:
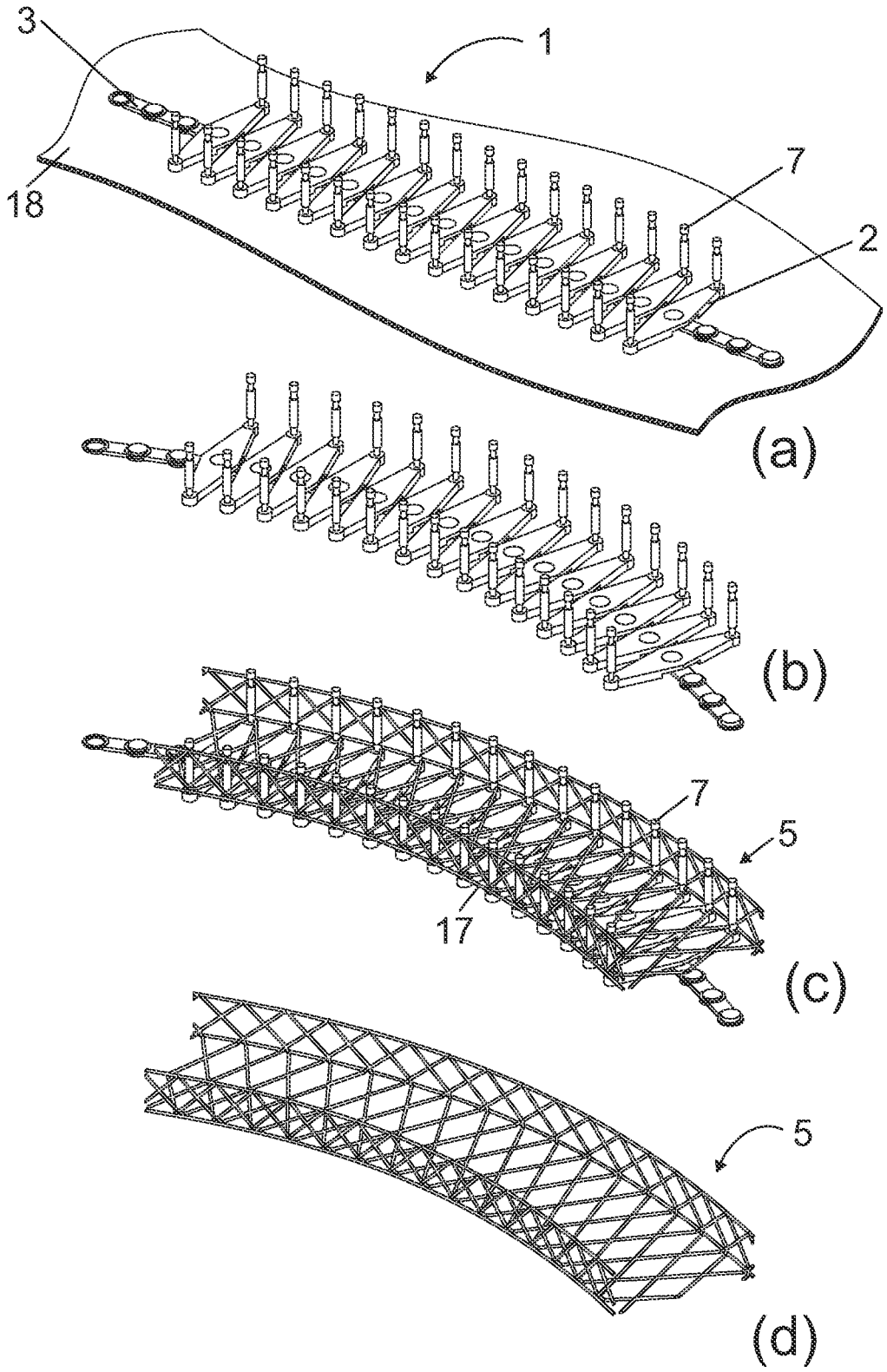
FIG. 3: Schematic of an embodiment of the process sequence according to the invention.

FIG. 3 schematically shows an embodiment of the process sequence according to the invention for producing the transverse force reinforcement 5 with the aid of the supporting device 1 according to the invention in four steps a) to d). First, according to the letter a), the supporting device 1 is placed on a supporting surface 18 on which the center chain 3 and the individual support elements 2 of the supporting device 1 provided with fixing pins 7 can slide as well as possible, at least during alignment or bending In the second illustration, under letter b), the curvature has already been produced. The yarn 17 is deposited over the fixing pins 7 until the complete transverse force reinforcement 5 is formed as in letter c). The yarn 17 has preferably been impregnated with a curable material before being placed. After it has cured, the now completed transverse force reinforcement 5 can be removed from the fixing pins 7 of the supporting device 1 and is thus ready for use. The completed transverse force reinforcement 5 detached from the supporting device 1 is shown under letter d).

Figure 4:
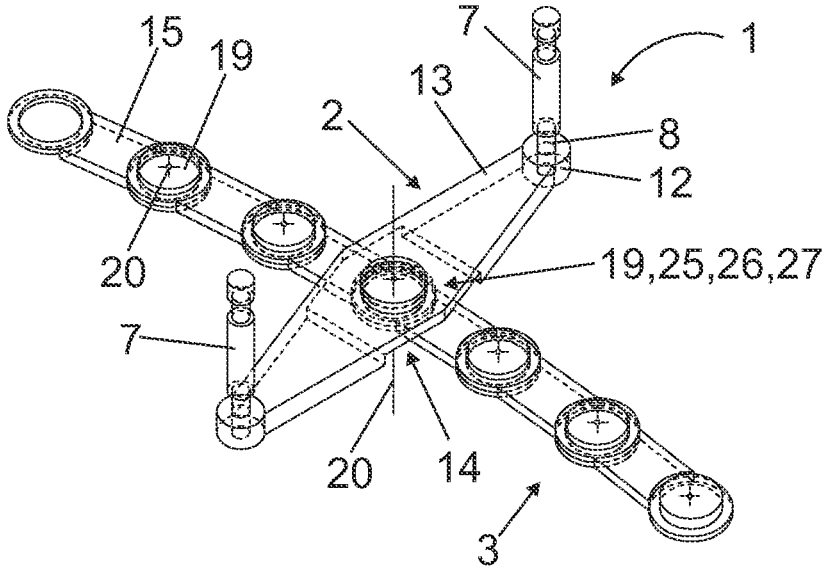
FIG. 4: Schematic perspective view of a center chain with attached support element of an embodiment of a supporting device according to the invention.

FIG. 4 schematically shows a perspective view of the center chain 3 with the attached support element 2 of an embodiment of a supporting device 1 according to the invention. The center chain 3 comprises the individual links 15, each of which is provided with one of the node points 19 so that the links 15 can pivot about a node point axis 20 by a certain angle. This enables the curvature of the center chain 3 and thus the intended position of the support elements 2 arranged on the center chain 3.

Furthermore, the support element 2 is shown as it is placed with its support element base body 13 centrally on the center chain 3 in the region of the node point 19. On its two arms pointing away from the center chain 3, the support element 2 has a pin receptacle 12 in each of which a fixing pin 7 with its pin seat 8 can be inserted.

In addition to the possibility of moving the support element 2 with the respective link 15 in a limited rotational movement or a pivoting movement when the center chain 3 is curved, a clearance 14 on the underside of the support element 2 facing the center chain 3 also allows it to move relative to the center chain 3. Furthermore, the clearance 14 ensures the mobility of the links 15 in the first place when they are in the area of a support element 2. The clearance 14 thus defines the angle by which the links 15 can be brought or pivoted towards each other around the node point axis 19. In the node point axis 19, the hinge 27 is formed by the hinge head 25 and the recess 26 in the support element 2. For a better understanding of the structure of the hinge 27, reference is made to FIG. 5.

Figure 5:
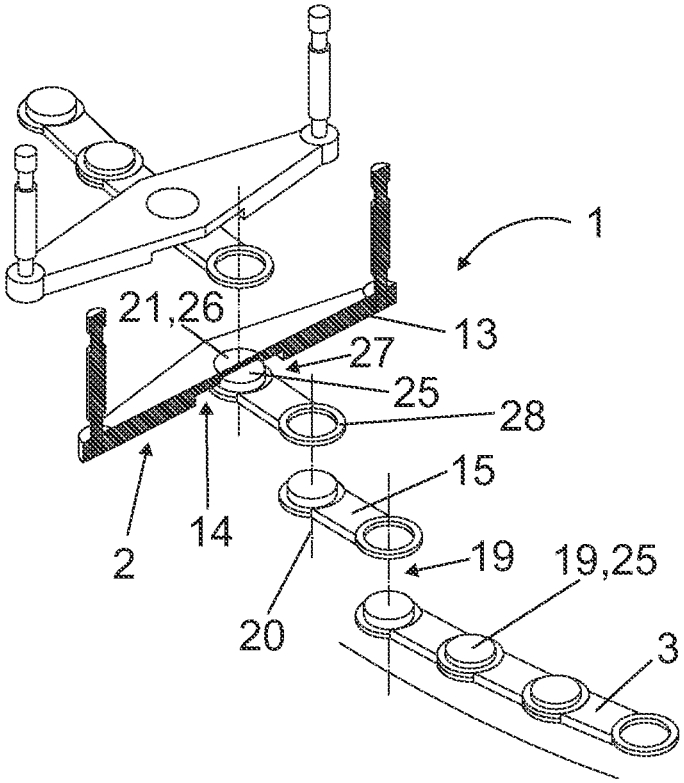
FIG. 5: Schematic exploded perspective view of a center chain with an embodiment of an attached support element.

FIG. 5 shows schematically in perspective exploded view a center chain 3 with attached support element 2, shown in sectional view, of an embodiment of a supporting device 1 according to the invention. Essentially the situation of FIG. 4 is shown, whereby the links 15 separated from the center chain, 3 show the structure and mode of operation of the node point 19. Here, each link 15 has a respective elevation, a hinge head 25, on which an annular element, a hinge ring 28, of the next following link 15 can be placed. The node point 19, comprising the main part of the hinge 27, is formed by the interaction of the hinge head 25 and the hinge ring 28. Accordingly, the hinge 27 is formed by the hinge head 25, the hinge ring 28 and also the recess 26 in the support element 2. The clearance 14 on the underside of the support element base body 13 allows the support element 2 to swivel in the plane.

Figure 6:
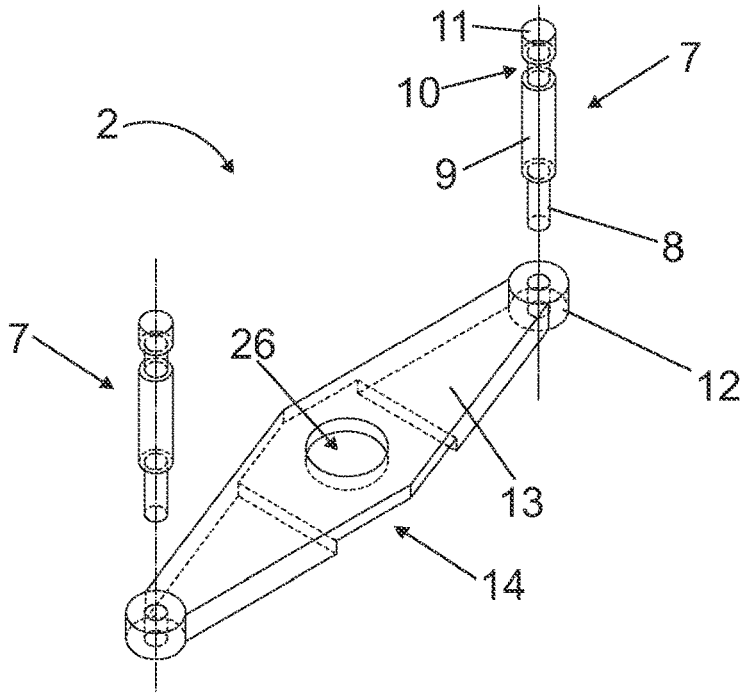
FIG. 6: Schematic perspective view of a support element with fixing pins before assembly as part of an embodiment of a supporting device according to the invention.

FIG. 6 shows schematically in perspective view a support element 2 with disassembled fixing pins 7 or in the position before assembly as part of an embodiment of a supporting device 1 according to the invention. The fixing pins 7 each have the pin seat 8, which is accommodated by the pin receptacle 12 in the support element base body 13 during assembly.

The pin seat 8 is adjoined by a pin body 9, which has a groove 10. The yarn is inserted into groove 10 when the yarn is deposited and secured there against slipping, provided that there is sufficient yarn tension. The upper end of the fixing pin 7 facing away from the support element 2 is formed by a head 11.

The recess 26 and the clearance 14 allow the support element 2 to pivot.

Figure 7:
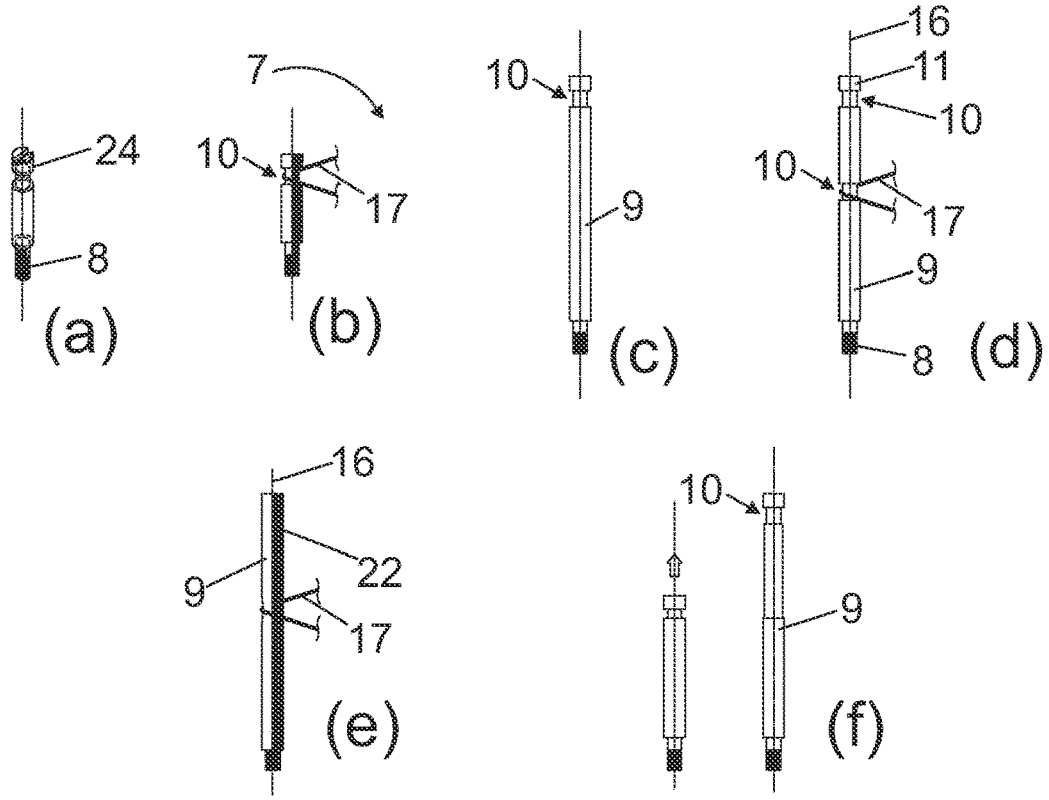
FIG. 7: Schematic and partly perspective illustrations of various embodiments of fixing pins.

FIG. 7 shows schematic and partly cut side views of various embodiments of fixing pins 7 as used in the supporting device 1 according to the invention. Here, under letter a), a fixing pin 7 is shown as already known from the previous figures. However, a special feature is the screw head 24, which, in cooperation with the pin seat 8 designed as a thread, enables the fixing pin 7 to be screwed into the support element 2 or the support element base body 13. The screwing in can be carried out manually or automatically, whereby in the latter case, the advantageous removal of the fixing pins 7 takes place from a magazine.

The same embodiment of the fixing pin 7, but in a partially cut representation and with the deposited yarn 17 inserted in the groove 10, is shown in letter b).

A similar embodiment is shown in letter c) but with a greater length of the pin base body 9. As a result, groove 10 is in a different position and allows a transverse force reinforcement to be produced with different dimensions, particularly with a greater height. An equally large length of the fixing pin 7 is shown in the illustration under letter d), whereby in addition to the upper groove 10, as can be seen in the illustration under letter c), there is a further groove 10 arranged underneath. This also has an inserted yarn 17 in the illustration according to letter d). Furthermore, a pin axis 16, the head 11, the pin base body 9, and the pin seat 8 are shown and designated.

Another embodiment of the fixing pin 7 can be seen under letter e), again including the deposited yarn 17. In contrast to the previous embodiments, there is no groove in the pin base body 9, but instead a pin coating 22, which is soft enough to allow the yarn 17 deposited under tension to leave a temporary indentation. In this recess, the yarn 17 is fixed and secured against unintentional movement along the pin axis 16, particularly against slipping downwards.

In the embodiment according to letter f), the pin base body 9 is telescopic and can be lengthened and shortened according to the specific requirements. In this case, groove 10 is arranged in the upper, movable part of the fixing pin 7. By extending or retracting the telescopically movable part of the pin base body 9, the vertical position of the groove 10 can thus be set up and adjusted accordingly.

Figure 8:
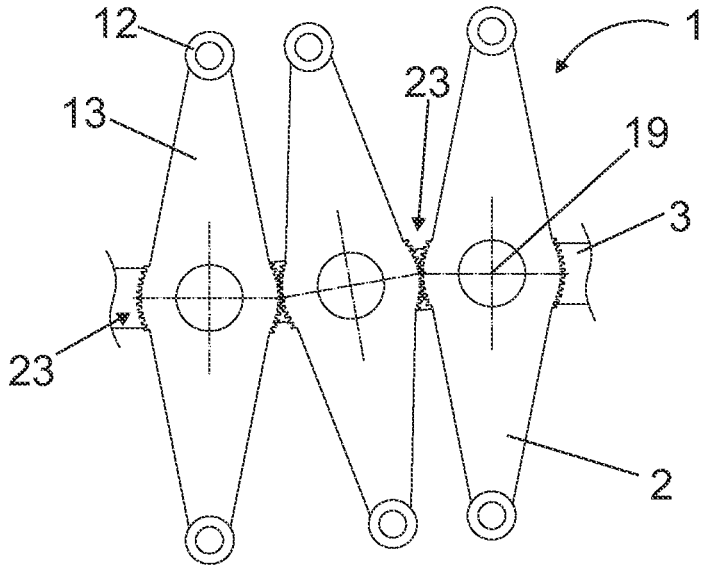
FIG. 8: Schematic representation of mechanically coupled support elements of an embodiment of the supporting device according to the invention.

FIG. 8 shows a schematic representation of mechanically coupled support elements 2 of an embodiment of the supporting device 1 according to the invention with a partially curved center chain 3. In this case, the support elements 2 or their support element base bodies 13 can no longer be freely pivoted with respect to the center chain 3 and around the node point 19, but instead, adjacent support elements 2 are mechanically coupled to each other in each case. This enables a defined relative movement. Unpredictable, incorrect, or unstable positions of the individual support elements 2 are avoided. In the embodiment shown, the mechanical coupling is implemented via gear segment 23, whereby the teeth of the gear segment 23 of the adjacent support elements 2 mesh with each other.

Figure 9:
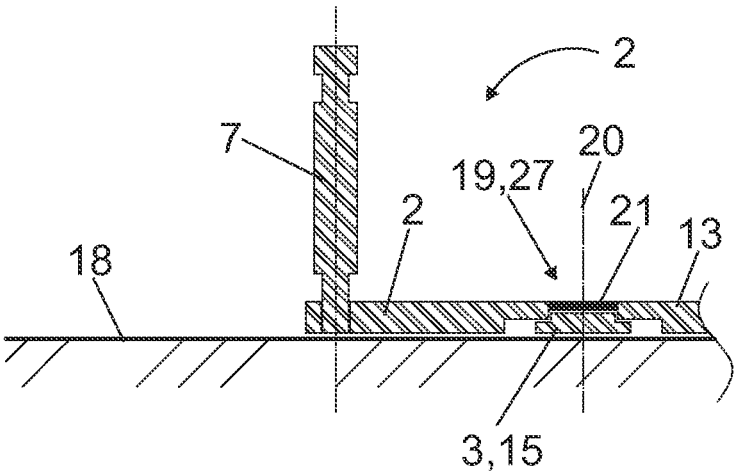
FIG. 9: Schematic sectional view of a support element with magnets.

FIG. 9 shows a schematic sectional view of a support element 2 with a magnet 21. Magnet 21 makes it possible to fix the center chain 3 as well as the support element 2 to the support surface 18. For this purpose, the support surface 18 must be made of a magnetic material, for example, steel. Furthermore, in the illustrated embodiment, element 2 is equipped with a magnetic element, magnet 21.

The magnet 21 not only ensures a secure connection between the individual parts joined together in the area of node point 19, but also still allows an appropriate mobility of the thus connected elements among each other. A clamp effect is created at least between three parts, the two links 15 of the center chain 3, which lie one above the other in the node point 19 as a hinge 27 (shown here in a simplified form without a joint ring), as well as the support element base body 13. Alternatively, one of the links 15 is clamped between the following link 15 and the support element base body 13 by the magnetic force. This effect is still achieved even if no support surface 18 made of a magnetic material is applied.

Figure 10:
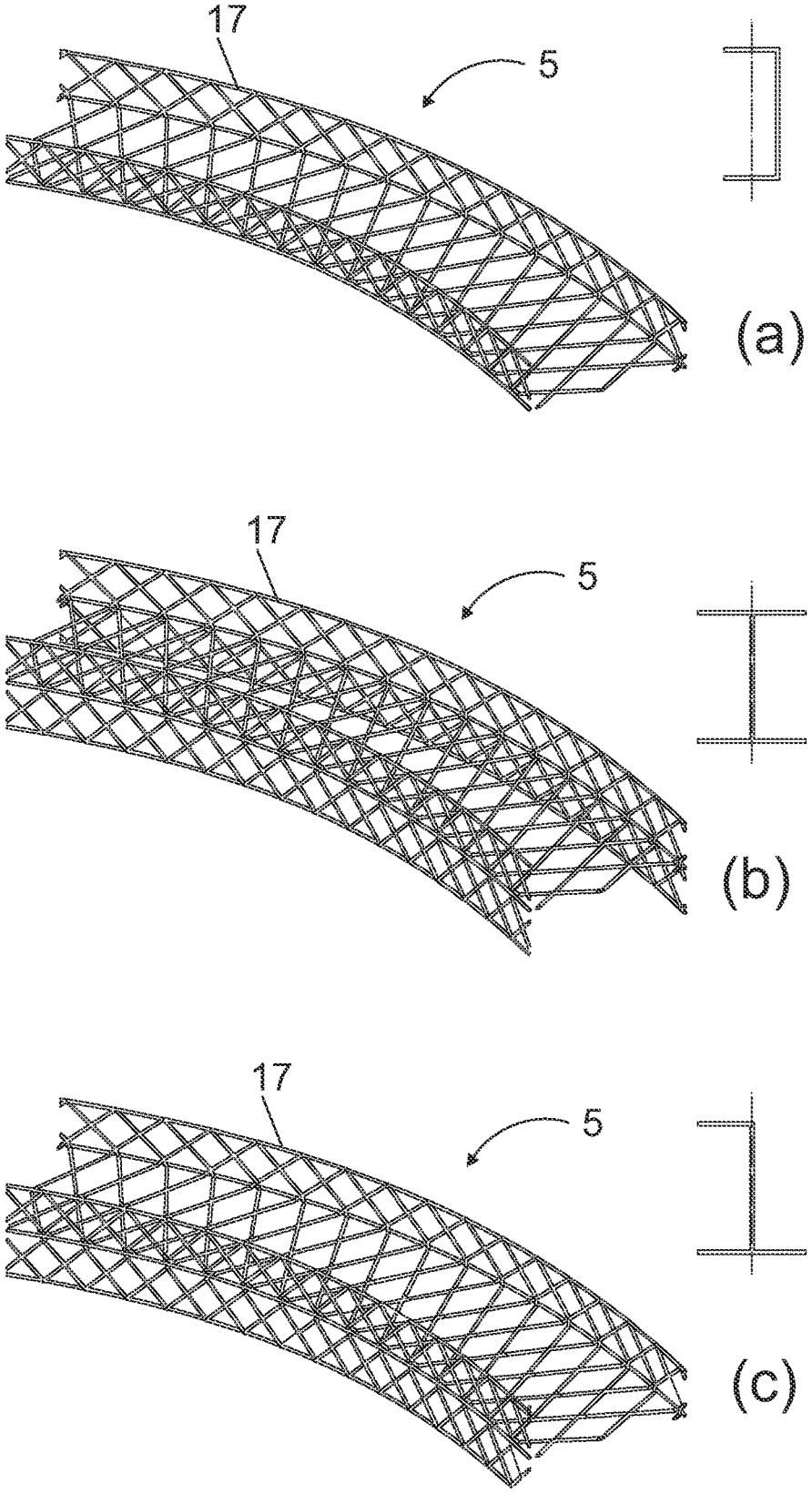
FIG. 10: Schematic perspective view of three different embodiments of the transverse force reinforcement according to the invention.

FIG. 10 shows a schematic perspective view of three different embodiments of the transverse force reinforcement 5 formed by means of yarn 17 according to the invention with different cross-sections, with which the two shells of a concrete sandwich structure can be reinforced and connected at the same time. In the letter a), the transverse force reinforcement 5 has a U-shaped profile, while the representation in letter b) has the cross section of a double-T beam (wide flange beam). A different cross-sectional shape is shown in letter c) and underlines the wide variety of cross-sectional shapes that can be produced. All three embodiment examples have in common that the transverse force reinforcement 5 is designed curved in the longitudinal direction.

Figure 11:
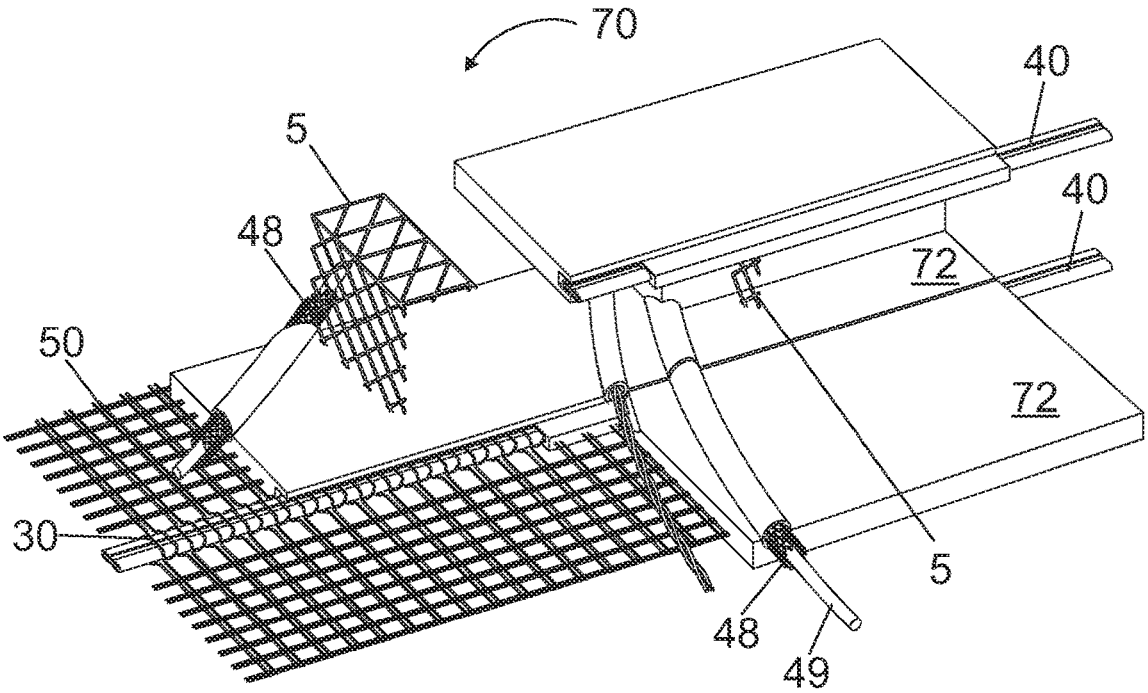
FIG. 11: Schematic perspective view of an embodiment of a concrete component.

FIG. 11 shows a schematic perspective view of an embodiment of a concrete component 70. In the embodiment shown, this is illustrated as a sandwich element comprising two shells. Concrete structural modules 72 of the two shells are each connected by a separate edge connection 40. The region shown without concrete cover illustrates the interlocking of yarn loops 30, each belonging to a reinforcement mesh 50 of both concrete structural modules 72.

Furthermore, the transverse reinforcement is shown 5, which both engages the two shells of the sandwich element and represents the connection and spacing structure between the two shells.

Further, a grid tubular reinforcement 48 is provided to allow and dissipate high forces in the intended direction, the longitudinal extent of the grid tubular reinforcement 48. The grid tubular reinforcement 48 is also suitable for dissipating forces across several concrete structural modules 72. For this purpose, reinforcement cable 49 is preferably inserted into the interior of the grid tubular reinforcement 48 and connects the concrete structural modules 72. In particular, in the event of a structure being overloaded, additional protection can be achieved in this way.

According to an alternative embodiment, the grid tubular reinforcement 48 may also be routed across several concrete structural modules 72 when the concrete is placed after the concrete structural modules 72 are connected.

LIST OF REFERENCE NUMERALS

1 Supporting device
2 Support element
3 Center chain
4 Compensating strips
5 Transverse force reinforcement
6 Shape actuator
7 Fixation pin
8 Pin seat
9 Pin base body
10 Groove
11 Head (fixation pin)
12 Pin receptacle
13 Support element base body
14 Clearance
15 Link (center chain)
16 Pin axis
17 Yarn
18 Support surface
19 Node point (center chain)
20 Node point axis
21 Magnet
22 Pin coating
23 Gear segment
24 Screw head
25 Hinge head
26 Recess
27 Hinge
28 Hinge ring
30 Yarn loops
40 Edge connector
48 Grid tubular reinforcement
49 Reinforcement cable
50 Reinforcement mat

The invention claimed is:

1. A supporting device (1) for producing a textile transverse force reinforcement (5), formed from at least one yarn (17) comprising fibers suitable for load transfer, characterized in that the supporting device (1) is bendable in a longitudinal direction in at least one plane perpendicular to its cross-section, wherein the supporting device (1) is provided for supporting the yarn (17) and is comprised of support elements (2) connected to each other by means of hinges (27) achieving a degree of freedom, wherein the hinges (27) between the support elements (2) are formed by cooperation with a center chain (3), in that each of the support elements (2) has a central cylindrical recess (26) in which a corresponding cylindrical hinge head (25) of the central chain (3) can be received, wherein the central chain (3) is comprised of links (15) hinged to the degree of freedom.

2. The supporting device (1), according to claim 1, wherein the support element (2) comprises at least one magnet (21) which is arranged such that the support element (2) is held on the hinge head (25) by means of magnetic force and, at the same time, two of the links (15) of the center chain (3) in each case are held together at the hinge (27) by means of the magnetic force.

3. The supporting device (1), according to claim 1, wherein the links (15) of the center chain (3) are detachable from each other and can be reassembled, and the supporting device (1) of any length can be created.

4. The supporting device (1), according to claim 1, wherein at least two of the adjacent support elements (2) are mechanically coupled for coordinated pivoting movement.

5. The supporting device (1), according to claim 1, wherein the supporting device (1) comprises fixing pins (7) around which the yarn (17) can be placed during yarn placement.

6. The supporting device (1), according to claim 5, wherein the fixing pins (7) have grooves (10) or a soft pin coating (22) for securing the position of the yarn (17) or a telescopic design for changing the length.

7. The supporting device (1), according to claim 1, wherein shaping actuators (6) and compensating strips (4) are provided, wherein the shaping actuators (6) are designed to exert force on the support elements (2) in the plane of curvature for setting the intended curvature of the supporting device (1) from at least one side, and the compensating strips (4) distribute the force effect of the shaping actuators (6) on the support elements (2).

* * * * *